US005494290A

United States Patent [19]

Stefanoski

[11] Patent Number: 5,494,290

[45] Date of Patent: Feb. 27, 1996

[54] LASER PUTTER

[76] Inventor: Vito Stefanoski, 38663 Harrison, Sterling Heights, Mich. 48310

[21] Appl. No.: 419,255

[22] Filed: Apr. 10, 1995

[51] Int. Cl.[6] ..... A63B 69/36

[52] U.S. Cl. ..... 273/186.3; 273/35 A

[58] Field of Search ..... 273/186.3, 35 A, 273/194 R, 183.1

[56] References Cited

U.S. PATENT DOCUMENTS

| | | | |
|---|---|---|---|
| 3,953,034 | 4/1976 | Nelson | 273/186.3 |
| 4,146,230 | 3/1979 | Foster | 273/183.1 |
| 5,207,429 | 5/1993 | Walmsley et al. | 273/186.3 |
| 5,213,331 | 5/1993 | Avanzini | 273/186.3 |
| 5,374,063 | 12/1994 | Ogden | 273/186.3 |
| 5,388,831 | 2/1995 | Quadri et al. | 273/186.1 |

*Primary Examiner*—George J. Marlo

[57] ABSTRACT

A laser putter comprised of a golf putter having a putting head, a shaft portion, and a hollow handle portion. A laser is secured to the hollow handle portion. A convex mirror is secured to the hollow handle portion downwardly of the laser secured thereto. A laser light beam is reflected from the convex mirror onto the ground forwardly of the putter head along a line perpendicular to the putting face to provide a line of sight which aids in lining up a putt. In a second embodiment, the light beam is reflected from a first flat mirror to a second flat mirror and then to the convex mirror.

5 Claims, 4 Drawing Sheets

LASER PUTTER

BACKGROUND OF THE INVENTION

1. Field of the Invention

The present invention relates to a laser putter and more particularly pertains to practicing aid for golfers which projects a visual sight line to aid in lining up a putt with a laser putter.

2. Description of the Prior Art

The use of laser training devices is known in the prior art. More specifically, laser training devices heretofore devised and utilized for the purpose of using lasers for golf training are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,284,345 to Jehn discloses a laser indicator to be used in golf training which is fastened to the visor of a golf player's cap.

U.S. Pat. No. 5,217,228 to De Aguilar discloses a golf club including light beam orienting device capable of generating a light beam in a path parallel to the theoretical path of a ball after being struck by the club.

U.S. Pat. No. 5,213,331 to Avanzini discloses a golf training putter with a laser sighting mounted onto the putter head of a conventional putter.

U.S. Pat. No. 5,193,812 to Hendricksen discloses a golf club with laser alignment system having a laser emission housing secured to a clubhead.

U.S. Pat. No. 5,165,691 to Cook discloses a laser golf club putter assembly including a laser beam assembly mounted on a basic putter club assembly.

U.S. Pat. No. 3,953,034 to Nelson discloses a laser beam golf swing training device.

While these devices fulfill their respective, particular objective and requirements, the aforementioned patents do not describe a laser putter for practicing aid for golfers which projects a visual sight line to aid in lining up a putt.

In this respect, the laser putter according to the present invention substantially departs from the conventional concepts and designs of the prior art, and in doing so provides an apparatus primarily developed for the purpose of practicing aid for golfers which projects a visual sight line to aid in lining up a putt.

Therefore, it can be appreciated that there exists a continuing need for new and improved laser putter which can be used for practicing aid for golfers which projects a visual sight line to aid in lining up a putt. In this regard, the present invention substantially fulfills this need.

SUMMARY OF THE INVENTION

In the view of the foregoing disadvantages inherent in the known types of laser training devices now present in the prior art, the present invention provides an improved laser putter. As such, the general purpose of the present invention, which will be described subsequently in greater detail, is to provide a new and improved laser putter and method which has all the advantages of the prior art and none of the disadvantages.

To attain this, the present invention essentially comprises a golf putter having a putting head, a shaft portion, and a hollow handle portion. The hollow handle portion has a padded outer layer secured thereto. The hollow handle portion has a removable end portion. The hollow handle portion has an upper chamber and a lower chamber therewithin. The upper chamber is accessible from the removable end portion. The upper chamber and the lower camber are separated by a retaining wall. The retaining wall has a through hole. The hollow handle portion has an aperture formed therein extending outwardly of the lower chamber. The lower chamber has a triangular wedge secured therein below the retaining wall. The triangular wedge has a front surface radially disposed from the aperture. The front surface of the triangular wedge is at forty-five degree angle from the hollow handle portion. The hollow handle portion has a conical shaped support ledge extending diagonally downward from the padded outer layer thereof. The conical shaped support ledge has a back surface radially disposed from the aperture. The back surface is at a forty-five degree angle from the hollow handle portion. A laser is secured within the upper chamber of the hollow handle portion. The laser generates a beam outwardly of the through hole of the retaining wall of the hollow handle portion. The laser has an activation mechanism extending outwardly within the padded outer layer of the hollow handle portion to be activated or de-activated by a user. The device contains two flat mirrors. A first mirror is secured to the front surface of the triangular wedge of the hollow handle portion. A second mirror is secured to the back surface of the support ledge of the hollow handle portion. The device contains a convex mirror secured to the padded outer layer of the hollow handle portion downwardly of the conical shaped support ledge thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved laser putter which has all the advantages of the prior art laser training devices and none of the disadvantages.

It is another object of the present invention to provide a new and improved laser putter which may be easily and efficiently manufactured and marketed.

It is a further object of the present invention to provide a new and improved laser putter which is of durable and reliable construction.

An even further object of the present invention is to provide a new and improved laser putter which is susceptible of a low cost of manufacture with regard to both materials and labor, and which accordingly is then susceptible of low prices of sale to the consuming public, thereby making such a laser putter economically available to the buying public.

Still yet another object of the present invention is to provide a new and improved laser putter which provides in the apparatuses and methods of the prior art some of the advantages thereof, while simultaneously overcoming some of the disadvantages normally associated therewith.

Even still another object of the present invention is to provide a new and improved laser putter for practicing aid for golfers which projects a visual sight line to aid in lining up a putt.

Lastly, it is an object of the present invention to provide a new and improved laser putter comprised of a golf putter having a putting head, a shaft portion, and a hollow handle portion. A laser is secured to the hollow handle portion. A convex mirror is secured to the hollow handle portion downwardly of the laser secured thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
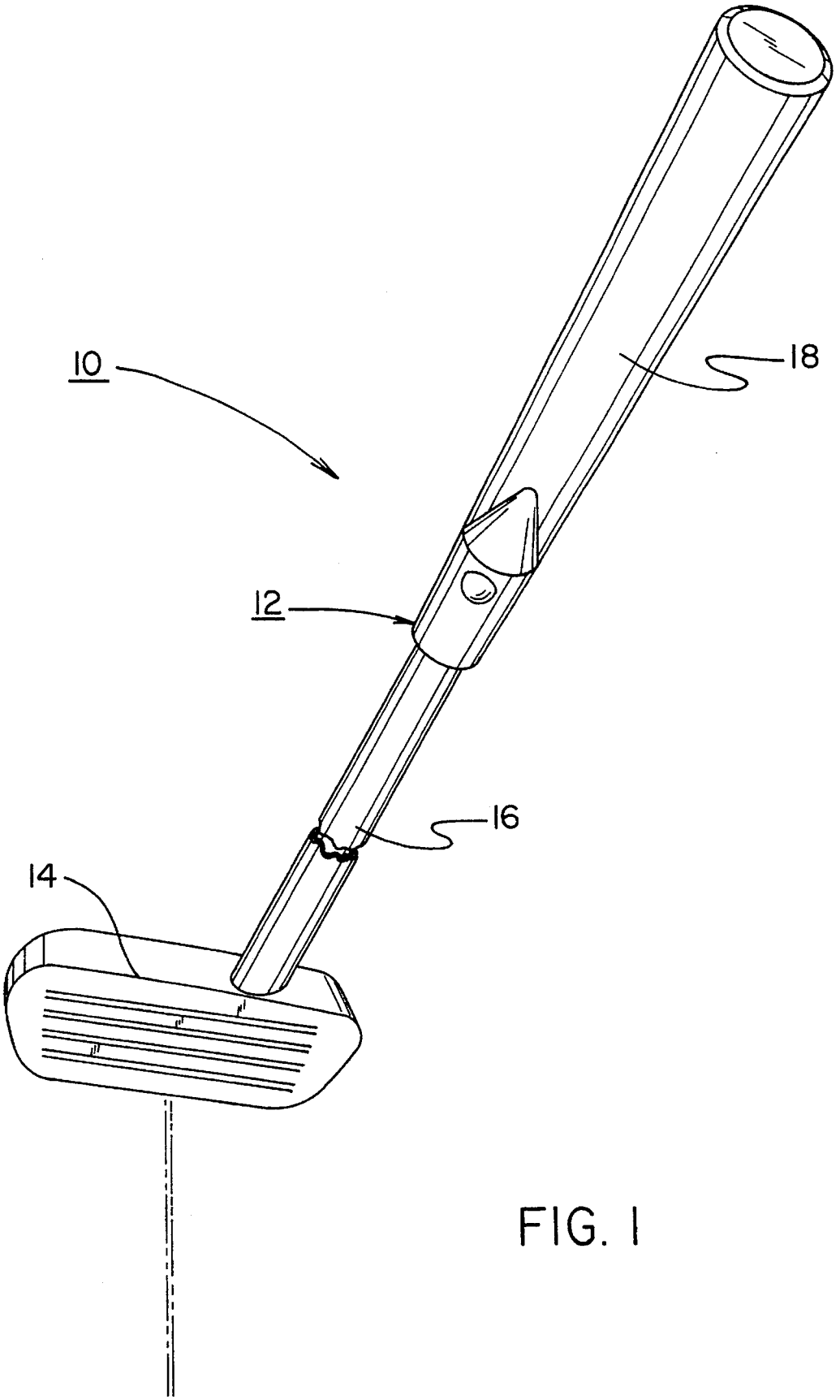
FIG. 1 is a perspective view of the preferred embodiment of the laser putter constructed in accordance with the principles of the present invention.
Figure 2:
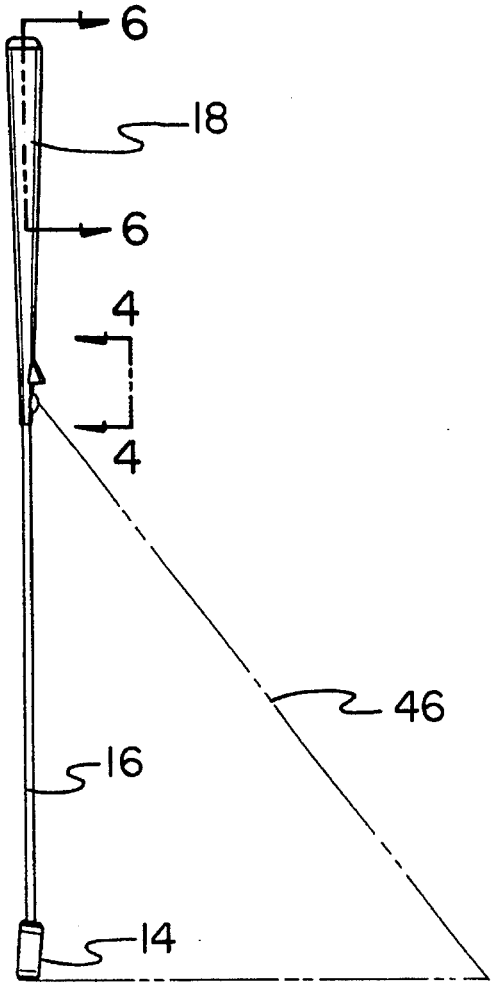
FIG. 2 is a front elevation view of the present invention in use.
Figure 3:
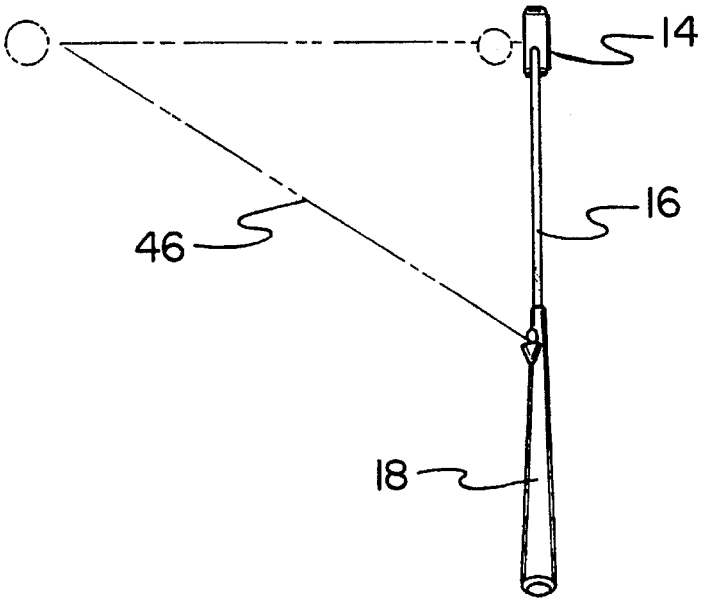
FIG. 3 is a front plan view of the present invention is use.
Figure 4:
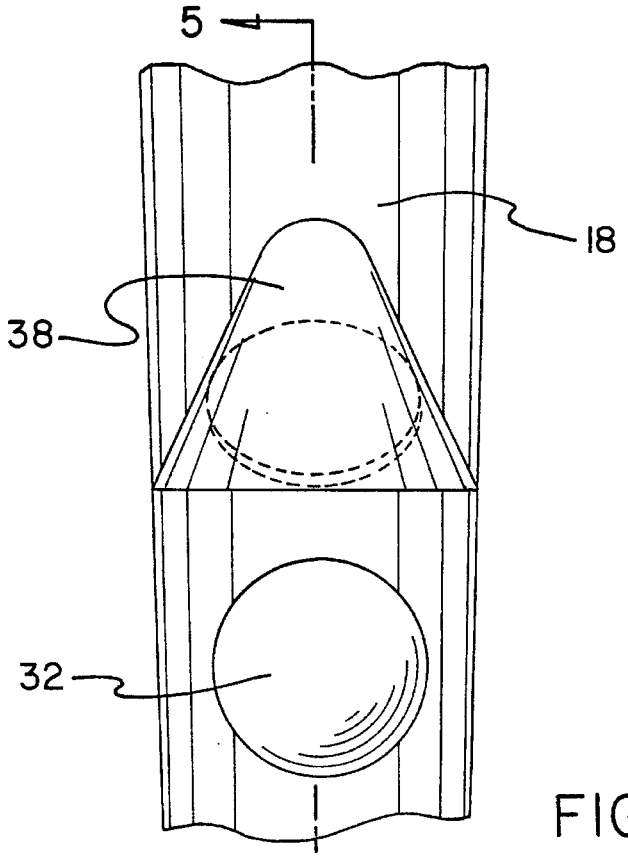
FIG. 4 is a side view as taken along line 4—4 of FIG. 2.
Figure 5:
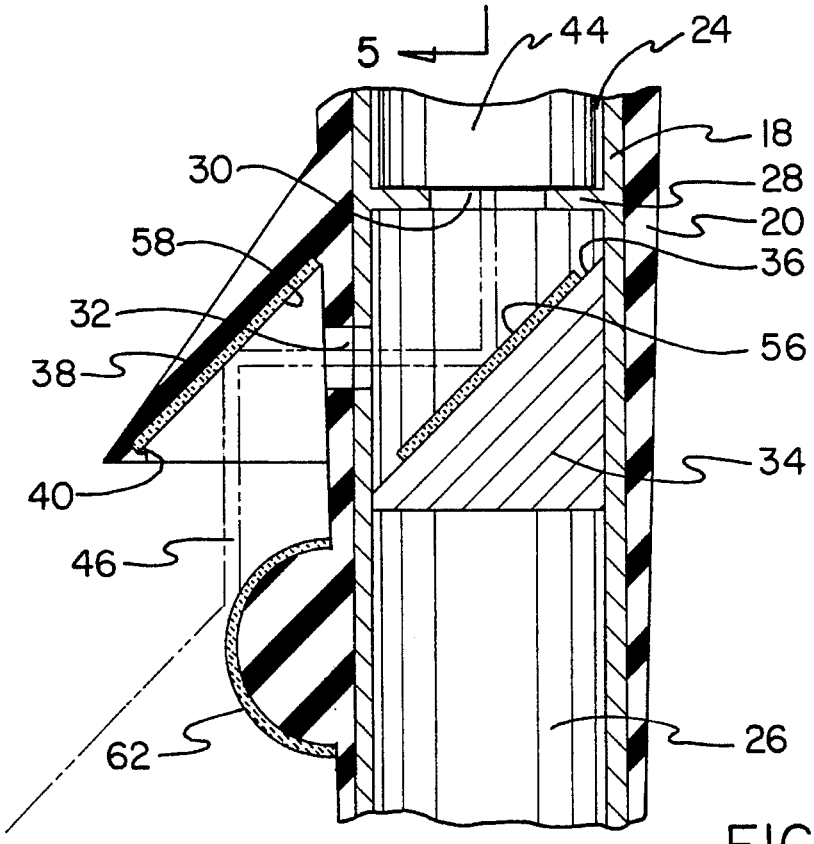
FIG. 5 is a cross-sectional view as taken along line 5—5 of FIG. 4.
Figure 6:
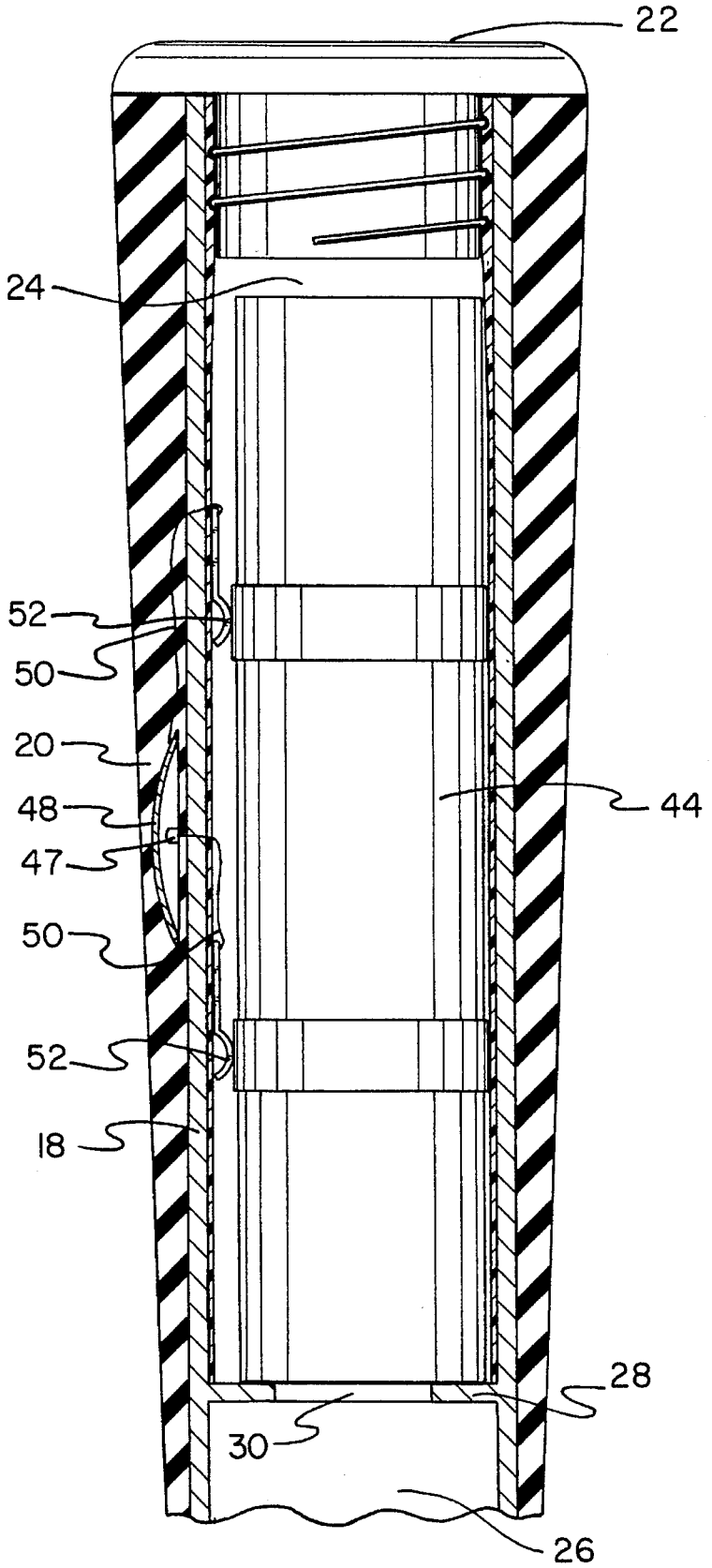
FIG. 6 is a cross-sectional view as taken along line 6—6 of FIG. 2.

With reference now to the drawings, and in particular, to FIG. 1–6 thereof, the preferred embodiment of the new and improved laser putter embodying the principles and concepts of the present invention and generally designated by the reference number 10 will be described.

Specifically, it will be noted in the various Figures that the device relates to a new and improved laser putter for practicing aid for golfers which projects a visual sight line to aid in lining up a putt. In its broadest context, the device consists of a golf putter, a laser, two flat mirrors, and a convex mirror.

The device 10 contains a golf putter 12 having a putting head 14, a shaft portion 16, and a hollow handle portion 18. The hollow handle portion 18 has a padded outer layer 20 secured thereto. The hollow handle portion 18 has a removable end portion 22. The hollow handle portion 18 has an upper chamber 24 and a lower chamber 26 therewithin. The upper chamber 24 is accessible from the removable end portion 22. The upper chamber 24 and the lower chamber 26 are separated by a retaining wall 28. The retaining wall 28 has a through hole 30. The hollow handle portion 18 has an aperture 32 formed therein extending outwardly of the lower chamber 26. The lower chamber 26 has a triangular wedge 34 secured therein below the retaining wall 28. The triangular wedge 34 has a front surface 36 radially disposed from the aperture 32. The front surface 36 of the triangular wedge 34 is at forty-five degree angle from the hollow handle portion 18. The hollow handle portion 18 has a conical shaped support ledge 38 extending diagonally downward from the padded outer layer 20 thereof. The conical shaped support ledge 38 has a back surface 40 radially disposed from the aperture 32. The back surface 40 is at a forty-five degree angle from the hollow handle portion 18.

A laser 44 is secured within the upper chamber 24 of the hollow handle portion 18. The laser 44 generates a beam 46 outwardly of the through hole 30 of the retaining wall 28 of the hollow handle portion 18. The laser 44 has an activation mechanism extending outwardly within the padded outer layer 20 of the hollow handle portion 18 to be activated or de-activated by a user. The activation mechanism comprises an on/off push button switch 47 protected by a shield 48 within the padded outer layer 20 of the hollow handle portion 18. The on/off push button switch 46 having sensor wires 50 extending inwardly of the hollow handle portion to couple with activation switches 52 that serve to activate or de-activate the beam 46 of the laser 44. When activated, the laser 44 sends a beam 46 down through the through hole 30 of the retaining wall 28 and into the lower chamber 26. The laser 44 can be removed from the upper chamber 24 of the hollow handle portion 18 through the removable end portion 22 thereof.

The device 10 contains two flat mirrors. A first mirror 56 is secured to the front surface 36 of the triangular wedge 34 of the hollow handle portion 18. A second mirror 58 is secured to the back surface 40 of the support ledge 38 of the hollow handle portion 18. When the laser 44 is activated, the beam 46 is directed into the through hole 30 of the retaining wall 28 and into the lower chamber 24 where the first mirror 56 directs the beam 46 outwardly of the aperture 32 of the hollow handle portion. The beam. 46 then contacts the second mirror 58 which directs the beam 46 downwardly.

The device 10 contains a convex mirror 62 secured to the padded outer layer 20 of the hollow handle portion 18 downwardly of the conical shaped support ledge 38 thereof.

When the laser 44 is activated, the convex mirror 62 receives the beam 46 after it contacts the second mirror 58 and directs the beam 46 downwardly. The convex mirror 62, in turn, projects the beam 46 out to a location forwardly of the ball being putted, along a line perpendicular to the putting head 14 of the golf putter 12. This provides a golfer with a line of sight to effectively practice putting.(See FIGS. 2–3)

The present invention is a putting practice aid for golfers which projects a visual sight line to aid in lining up a putt.

This device 10 employs a small low power laser 44 of the type used for a pointing device in presentations. It either attaches to the putter shaft with hook and loop straps, or could be incorporated into the design of the club and enclosed inside the handle 18. The beam 46 is pointed downward along the shaft 16, and is directed forwardly of the putting head 14 through a single mirror or series of mirrors. A single convex mirror 62 is used for the externally mounted device, while the one incorporated into the handle 18 requires a total of three mirrors, two flat ones 56,58 and the third a convex one 62. These are oriented and affixed to the putter 12 at exact locations to bring the laser 44 beam 46 to a location forwardly of the center of the putting head 14. The final mirror is convex in shape, and projects the beam 46, to a location along a line 66 perpendicular to the putting head 14 and onto the ground.

The laser's 44 beam 46 is directed either onto the single convex mirror 62, or onto the series of mirrors 56,58 and finally onto the convex mirror 62. The surface of this last mirror 62 causes the beam 46 to be formed into a line that shines down onto the ground at a location along a line 66 perpendicular to the face on the putting head 14.

Ideal for practicing putting, this golf putter 12 gives a very accurate indication of the club alignment with relation to the cup. The weight is negligible and does not affect the balance or performance of the putter 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A laser putter for golfers which projects a visual sight line to aid in lining up a putt comprising, in combination:

a golf putter having a putting head, a shaft portion, and a hollow elongated handle portion, the hollow handle portion having a padded outer layer secured thereto, the hollow handle portion having a removable end portion, the hollow handle portion having an upper chamber and a lower chamber therewithin, the upper chamber accessible from the removable end portion, the upper chamber and the lower chamber being separated by a retaining wall, the retaining wall having a through hole, the hollow handle portion having an aperture formed therein extending laterally outward of the lower chamber, the lower chamber having a triangular wedge secured therein below the retaining wall, the triangular wedge having a front surface radially disposed from the aperture, the front surface of the triangular wedge being at a forty-five degrees angle from the hollow elongated handle portion, the hollow handle portion having a conical shaped support ledge extending diagonally downward and outward from the padded outer layer thereof, the conical shaped support ledge having a back surface radially disposed outwardly from the aperture in the handle portion, the back surface being at a forty-five degree angle from the hollow elongated handle portion;

a laser secured within the upper chamber of the hollow handle portion and positioned to project a beam through the hole in the retaining wall of the hollow handle portion, the laser having an activation mechanism extending outwardly within the padded outer layer of the hollow handle portion to be activated or de-activated by a user;

two flat mirrors, a first mirror secured to the front surface of the triangular wedge of the hollow handle portion, a second mirror secured to the back surface of the support ledge of the hollow handle portion;

a convex mirror secured to the padded outer layer of the hollow handle portion downwardly of the conical shaped support ledge thereof, so that the beam from said laser may be reflected from said first mirror to said second mirror to said convex mirror to the ground forwardly of the putter to provide a line of sight to aid in lining up a putt.

2. A laser putter for golfers which projects a visual sight line to aid in lining up a putt comprising, in combination:

a golf putter having a putting head, a shaft portion, and a hollow handle portion;

a laser secured to the hollow handle portion;

a convex mirror secured to the hollow handle portion downwardly of the laser secured thereto, and means for directing a light beam from said laser to said convex mirror so that said convex mirror reflects a light beam onto the ground forwardly of the putter head along a line perpendicular to the putting face and provides a line of sight which aids in lining up a putt.

3. The laser putter as described in claim 2 and further including wherein the hollow handle portion of the golf putter having a padded outer layer secured thereto, the hollow handle portion having a removable end portion, the hollow handle portion having an upper chamber and a lower chamber therewithin, the upper chamber accessible from the removable end portion, the upper chamber and the lower camber being separated by a retaining wall, the retaining wall having a through hole, the hollow handle portion having an aperture formed therein extending outwardly of the lower chamber, the lower chamber having a triangular wedge secured therein below the retaining wall, the triangular wedge having a front surface radially disposed from the aperture, the front surface of the triangular wedge being at forty-five degree angle from the hollow handle portion, the front surface having a first flat mirror theresecured, the hollow handle portion having a conical shaped support ledge extending diagonally downward from the padded outer layer thereof, the conical shaped support ledge having a back surface radially disposed from the aperture, the back surface being at a forty-five degree angle from the hollow handle portion, the back surface having a second flat mirror there-secured.

4. The laser putter as described in claim 3 and further including wherein the laser being secured within the upper chamber of the hollow handle portion.

5. The laser putter as described in claim 4 wherein the convex mirror is secured to the padded outer layer of the hollow handle portion downwardly of the conical shaped support ledge thereof.

* * * * *